US012466598B2

(12) United States Patent
Yang et al.

(10) Patent No.: US 12,466,598 B2
(45) Date of Patent: Nov. 11, 2025

(54) ADJUSTING DEVICE, PACKAGING APPARATUS AND ADJUSTING METHOD

(71) Applicant: CONTEMPORARY AMPEREX TECHNOLOGY (HONG KONG) LIMITED, Hong Kong (CN)

(72) Inventors: Mukai Yang, Fujian (CN); Wensheng Pan, Fujian (CN); Qinkun Huang, Fujian (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 0 days.

(21) Appl. No.: 18/389,220

(22) Filed: Nov. 14, 2023

(65) Prior Publication Data

US 2024/0092518 A1 Mar. 21, 2024

Related U.S. Application Data

(63) Continuation of application No. PCT/CN2023/082730, filed on Mar. 21, 2023.

(30) Foreign Application Priority Data

May 30, 2022 (CN) ..... 202210597329.5

(51) Int. Cl.
*B65B 57/00* (2006.01)
*B65B 61/00* (2006.01)
*B65B 65/02* (2006.01)

(52) U.S. Cl.
CPC ..... *B65B 57/00* (2013.01); *B65B 61/00* (2013.01); *B65B 65/02* (2013.01)

(58) Field of Classification Search
CPC ..... B65B 57/00; B65B 61/00; B65B 65/02
(Continued)

(56) References Cited

U.S. PATENT DOCUMENTS 6,439,631 B1 8/2002 Kress
2006/0119345 A1* 6/2006 Ham ..... G01R 31/2893 324/757.01

(Continued)

FOREIGN PATENT DOCUMENTS

CN 202776912 U 3/2013
CN 205034407 U 2/2016

(Continued)

OTHER PUBLICATIONS

International Search Report and Written Opinion mailed on Jun. 8, 2023, received for PCT Application PCT/CN2023/082730, filed on Mar. 21, 2023, 14 pages including English Translation.

(Continued)

*Primary Examiner* — Anna K Kinsaul
*Assistant Examiner* — Mary C Hibbert-Copeland
(74) *Attorney, Agent, or Firm* — XSENSUS LLP

(57) ABSTRACT

The present application relates to an adjusting device, a packaging apparatus, and an adjusting method. In the adjusting device, a first adjuster may provide a first adjustment for a structure to be adjusted such that all the structures to be adjusted are disposed at equal intervals along theoretical spacings in a first direction (a), and a second adjuster may adjust a spacing between the structure to be adjusted and a structure to be adjusted adjacent thereto such that the structures to be adjusted may be disposed in alignment with corresponding receptacles, facilitating precise placement of each structure to be adjusted in the corresponding receptacle.

14 Claims, 5 Drawing Sheets

(58) Field of Classification Search
USPC ..... 53/52
See application file for complete search history.

(56) References Cited

U.S. PATENT DOCUMENTS

| | | | | |
|---|---|---|---|---|
| 2012/0104782 | A1* | 5/2012 | Weaver | B65B 35/36<br>294/87.1 |
| 2017/0203865 | A1 | 7/2017 | Kalany et al. | |

FOREIGN PATENT DOCUMENTS

| | | | |
|---|---|---|---|
| CN | 105742687 | A | 7/2016 |
| CN | 105775711 | A | 7/2016 |
| CN | 208979193 | U | 6/2019 |
| CN | 209582993 | U | 11/2019 |
| CN | 209979699 | U | 1/2020 |
| CN | 112455751 | A | 3/2021 |
| CN | 213443482 | U | 6/2021 |
| CN | 213827773 | U | 7/2021 |
| CN | 215116412 | U | 12/2021 |
| CN | 113945258 | A | 1/2022 |
| CN | 215753265 | U | 2/2022 |
| CN | 216104719 | U | 3/2022 |
| DE | 202010001712 | U1 | 6/2011 |
| KR | 20-0457972 | Y1 | 1/2012 |

OTHER PUBLICATIONS

First Office Action mailed on Sep. 19, 2023, received for CN Application 202210597329.5, 22 pages including English Translation.
1 Extended European Search Report issued Aug. 26, 2024 European Patent Application No. 23792856.9.

* cited by examiner

ADJUSTING DEVICE, PACKAGING APPARATUS AND ADJUSTING METHOD

CROSS-REFERENCE TO RELATED APPLICATIONS

The present application is a continuation of International Application No. PCT/CN2023/082730, filed Mar. 21, 2023, which claims priority to Chinese patent application no. 202210597329.5, filed on May 30, 2022, and entitled "ADJUSTING DEVICE, PACKAGING APPARATUS AND ADJUSTING METHOD", each of which is incorporated herein by reference in its entirety.

TECHNICAL FIELD

The present application relates to the technical field of battery processing, and particularly to an adjusting device, a packaging apparatus and an adjusting method.

BACKGROUND ART

With the development of new energy technology, batteries become increasingly important in life and are increasingly widespread. With a significant increase in battery production capacity and production efficiency, a battery packaging process takes up a lot of production time. In addition, a battery packaging material has a poor dimensional precision after being shaped, and spacings between cell receptacles in the packaging material are poorly consistent, resulting in a low battery packaging efficiency, which affects overall battery production efficiency.

SUMMARY OF THE DISCLOSURE

In view of this, it is necessary to provide an adjusting device, a packaging apparatus and an adjusting method against the problems that a battery packaging process takes long time and is low in efficiency.

In a first aspect, the present application provides an adjusting device, including a first adjusting mechanism or adjuster, at least two follower mechanisms or followers, and at least two second adjusting mechanisms or adjusters. Each of the follower mechanisms is movably disposed on the first adjusting mechanism in a first direction, the second adjusting mechanisms are connected to the follower mechanisms in one-to-one correspondence, and all the second adjusting mechanisms can follow the follower mechanisms where they are located to move synchronously in the first direction relative to the first adjusting mechanism. Each of the second adjusting mechanisms includes a power assembly and a bearing member or bearing that are mounted on each of the follower mechanisms, the bearing members are in transmission connection with the power assemblies respectively, and the second adjusting mechanisms can adjust, in the first direction, a spacing between the bearing members adjacent to the power assemblies under the action of the corresponding power assemblies.

In a technical solution of an embodiment of the present application, bearing members on the second adjusting mechanisms may be connected to members to be adjusted in one-to-one correspondence, the first adjusting mechanism first drives the follower mechanisms to move in the first direction, the follower mechanisms drive the second adjusting mechanisms corresponding thereto to move in the first direction, and therefore, a first coarse adjustment of a spacing between the adjacent members to be adjusted may be achieved. Further, the second adjusting mechanism may, based on the first coarse adjustment, provide a second fine adjustment in the first direction for the members to be adjusted on at least some of the bearing members, so that the spacings between every two adjacent members to be adjusted match target spacings in one-to-one correspondence, and each member to be adjusted is precisely positioned even if specific positions of the members to be adjusted are in one-to-one correspondence with target positions.

In some embodiments, the first adjusting mechanism includes an adjusting member or structure that is movably disposed in a second direction intersecting with the first direction. Each of the follower mechanisms can convert movement of the first adjusting mechanism in the second direction into movement of the second adjusting mechanism connected thereto in the first direction.

In a technical solution of an embodiment of the present application, as the follower mechanisms convert the movement of the first adjusting mechanism in the second direction into the movement of the second adjusting mechanisms connected thereto in the first direction, the first adjusting mechanism can occupy a reduced space in the first direction, further reducing an entire occupied space for the adjusting device and allowing the space to be reasonably utilized.

In some embodiments, the adjusting member is provided with at least two adjusting slots, and each of the follower mechanisms includes a follower seat and a follower member or structure disposed on the follower seat. All the adjusting slots are disposed at intervals in the first direction and are disposed radially in the second direction, and the follower members are disposed in the adjusting slots in one-to-one correspondence.

In a technical solution of an embodiment of the present application, mutual cooperation of the adjusting slots and the follower members may allow for conversion of the movement of the adjusting member in the second direction into the movement of the follower members in the first direction, achieving a simple structure and stable connections.

In some embodiments, the first adjusting mechanism further includes a first slide rail and a first slider, the first slide rail is disposed extending in the second direction, and the first slider is connected slidably between the adjusting member and the first slide rail in the second direction.

In a technical solution of an embodiment of the present application, on the one hand, mutual cooperation of the first slide rail and the first slider can reduce frictional resistance of the adjusting member in a moving process, making the moving process of the adjusting member smoother. On the other hand, the first slide rail can also provide a support basis for the adjusting member, so that the adjusting member is disposed more stably.

In some embodiments, the first adjusting mechanism includes a driving member or driver in driving connection with an adjusting member or structure, the driving member functioning to drive the adjusting member to move in the second direction.

In a technical solution of an embodiment of the present application, the driving member may provide a driving force for the adjusting member to move in the second direction, and a moving distance of the adjusting member in the second direction can be accurately controlled by controlling the driving member to be turned on or off.

In some embodiments, the adjusting device includes a first support base and a second slide rail extending in the first direction on the first support base, and each of the follower mechanisms is provided with a second slider that is disposed slidably on the second slide rail in the first direction.

In a technical solution of an embodiment of the present application, on the one hand, mutual cooperation of the second slide rail and the second slider can reduce frictional resistance of each of the follower mechanisms when moving in the first direction, making a moving process of each of the follower mechanisms smoother. On the other hand, the second slide rail may provide a support basis for each of the follower mechanisms, so that the follower mechanisms are disposed more stably.

In some embodiments, each of the power assemblies includes a transmission member or structure and a linkage member or structure, and the linkage member is connected between the transmission member and a bearing member and drives the bearing member to move in the first direction.

In a technical solution of an embodiment of the present application, the transmission member may provide a driving force for the bearing member by the linkage member to move in the first direction.

In some embodiments, each of the power assemblies includes a second support base secured on a corresponding follower mechanism, each of the transmission members is rotatably disposed on the second support base, and the linkage member functions to convert rotational movement of the transmission member into linear movement of the bearing member in the first direction.

In a technical solution of an embodiment of the present application, the rotational movement of the transmission members may be converted into the linear movement of the bearing members in the first direction through the linkage members, enabling the transmission members to occupy less space on the second support base, the entire structure of the power assemblies to be more simplified and less space to be occupied.

In some embodiments, each of the power assemblies includes a power member or structure, the transmission member includes an eccentric shaft and a follower wheel, one end of the eccentric shaft is in transmission connection with the power member, and the follower wheel is disposed at the other end of the eccentric shaft. One end of the linkage member is fixedly connected to the bearing member, with the other end sleeving over the follower wheel, and the linkage member can move linearly in the first direction under the action of an eccentric force of the follower wheel.

In a technical solution of an embodiment of the present application, when the follower wheel rotates synchronously with the eccentric shaft, the eccentric force may be transmitted to the linkage member to allow for conversion between the rotational movement and the linear movement, and the bearing member may be driven to move linearly in the first direction through the linkage member to allow for positional adjustment of a member to be adjusted on the bearing member.

In some embodiments, the adjusting device includes at least two clamping mechanisms or dampers disposed on bearing members in one-to-one correspondence, and each of the clamping mechanisms has a clamping space for securing a member to be adjusted.

In a technical solution of an embodiment of the present application, each clamping mechanism may stably connect the corresponding member to be adjusted to the corresponding bearing member, allowing the bearing member to smoothly drive the member to be adjusted to move in the first direction.

In some embodiments, each of the clamping mechanisms includes a first clamping member or structure and a second clamping member or structure that are movably disposed on a corresponding bearing member in the first direction, and a clamping space is defined between the first clamping member and the second clamping member in the first direction.

In a technical solution of an embodiment of the present application, when the first clamping member and the second clamping member are moved close to or far away from each other in the first direction, the size of the clamping space may be adjusted, such that the clamping space may adapt to a variety of different dimensions of members to be adjusted, and practicability of the adjusting device is improved.

In some embodiments, the adjusting device includes a control assembly, and the control assembly is in communicative connection with the power assemblies and can control the power assemblies to be turned on or off.

In a technical solution of an embodiment of the present application, the control assembly enables precise control for each of the power assemblies, ensuring that the power assembly drives the bearing member to move by a fixed distance in the first direction, so as to enable accurate positioning for a position of the bearing member.

In a second aspect, the present application provides a packaging apparatus, including an adjusting device as described above and a packaging box, the adjusting device functions to adjust a spacing between two adjacent members to be adjusted, the packaging box is provided with a plurality of groups of receptacles, each group of receptacles includes at least two receptacles disposed at intervals in the first direction, and the receptacles serve to hold the members to be adjusted.

In a technical solution of an embodiment of the present application, the spacing between the two adjacent members to be adjusted is adjusted through the adjusting device, such that the spacing between every two adjacent members to be adjusted matches an actual spacing between two adjacent receptacles corresponding thereto, that is, each member to be adjusted and the corresponding receptacle are aligned in position, so as to facilitate storage of the member to be adjusted in the corresponding receptacle, allowing for rapid packaging of the members to be adjusted.

In a third aspect, the present application provides a method for adjusting a spacing between two adjacent cells, the method including the following steps:

- acquiring a theoretical spacing between two adjacent cell receptacles on a cell packaging box in a first direction;
- adjusting all cells to move in the first direction, so that a spacing between two adjacent cells in the first direction equals the theoretical spacing;
- acquiring an actual spacing between the two adjacent cell receptacles on the cell packaging box; and
- adjusting a spacing between every two adjacent cells to match the actual spacing between two adjacent cell receptacles corresponding thereto.

In a technical solution of an embodiment of the present application, mutual cooperation of the first coarse adjustment and the second fine adjustment enables the spacing between every two adjacent cells to match the actual spacing between the two adjacent cell receptacles corresponding thereto, so that each cell can be accurately placed in the corresponding cell receptacle, allowing for rapid packaging of the cells.

According to the adjusting device, the packaging apparatus and the adjusting method described above, the first adjusting mechanism drives all the follower mechanisms to move in the first direction so as to drive the second adjusting mechanisms arranged on the follower mechanisms to move in the first direction, allowing for a first adjustment of members to be adjusted, such that all the members to be adjusted are disposed at equal intervals in theoretical spacings in the first direction. On this basis, at least some of the power assemblies may drive the bearing members corresponding thereto to continue moving in the first direction so as to adjust, for some of the members to be adjusted, spacings between them and the adjacent members to be adjusted, such that the spacing between every two adjacent members to be adjusted matches the actual spacing between two adjacent receptacles corresponding thereto, facilitating precise placement of each member to be adjusted in the corresponding receptacle.

The above description is only an overview of the technical solutions of the present application. In order to more clearly understand the technical means of the present application to implement same according to the contents of the description, and in order to make the above and other objectives, features and advantages of the present application more obvious and understandable, specific implementations of the present application are exemplarily described below.

BRIEF DESCRIPTION OF THE DRAWINGS

Various other advantages and benefits will become apparent to those of ordinary skill in the art upon reading the following detailed description of the embodiments. The accompanying drawings are merely for the purpose of illustrating the embodiments, and are not to be construed as limiting the present application. Moreover, like components are denoted by like reference numerals throughout the accompanying drawings. In the drawings.

Figure 1:
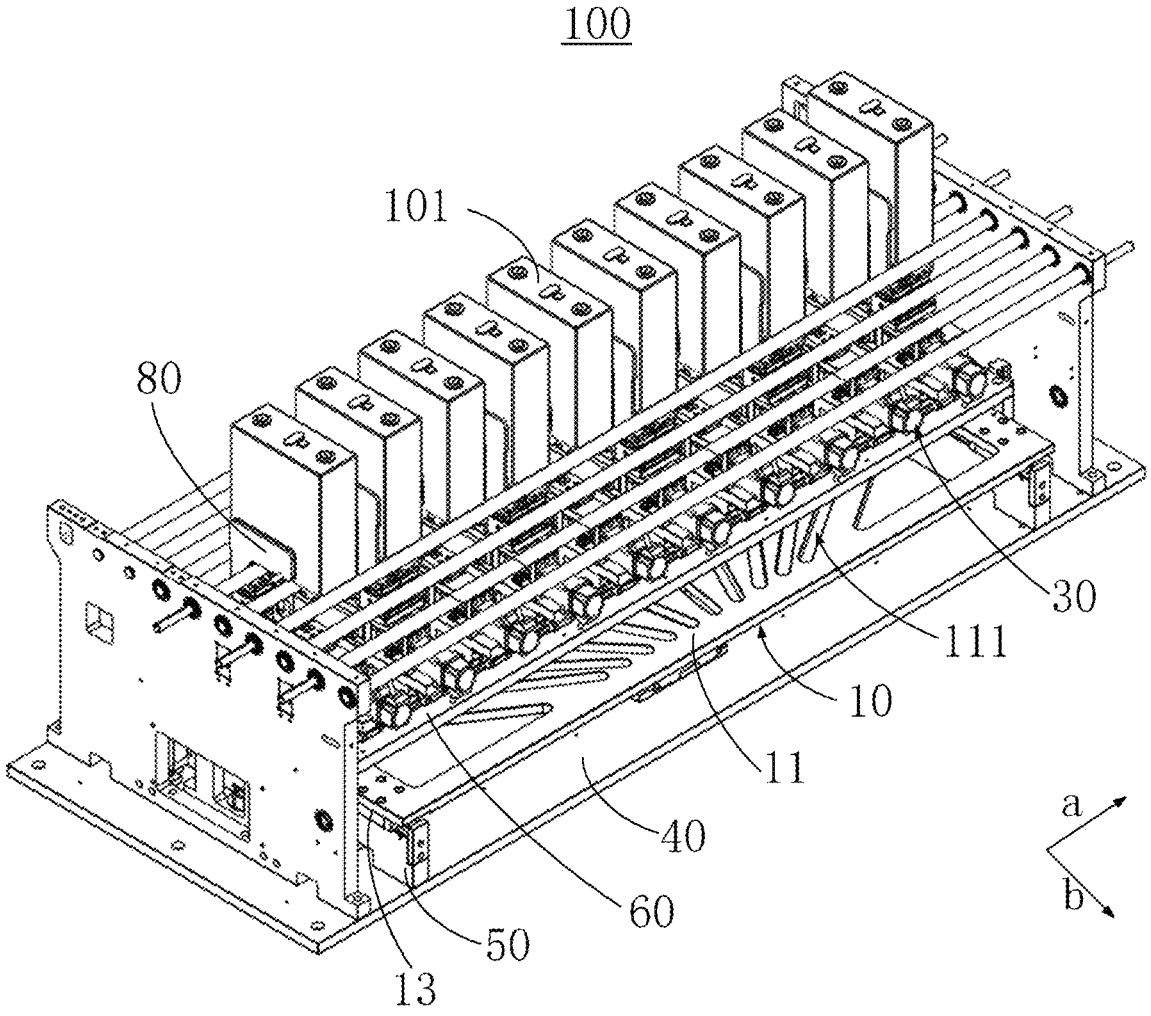
FIG. 1 is a schematic structural diagram of an adjusting device according to one or more embodiments.

100—Adjusting device; 101—Member to be adjusted; 10—First adjusting mechanism; 20—Follower mechanism; 30—Second adjusting mechanism; 40—Base; 50—Support; 60—First support base; 70—Second slide rail; 80—Clamping mechanism; 11—Adjusting member; 12—First slide rail; 13—First slider; 14—Driving member; 21—Follower seat; 22—Follower member; 23—Second slider; 31—Power assembly; 32—Bearing member; 81—Clamping space; 82—First clamping member; 83—Second clamping member; 111—Adjusting slot; 311—Transmission member; 312—Linkage member; 313—Second support base; 314—Power member; 3111—Eccentric shaft; 3112—Follower wheel; a—First direction; b—Second direction.

DETAILED DESCRIPTION OF EMBODIMENTS

Embodiments of the technical solutions of the present application will be described in detail below with reference to the accompanying drawings. The following embodiments are merely intended to more clearly illustrate the technical solutions of the present application, so they merely serve as examples, but are not intended to limit the scope of protection of the present application.

Unless otherwise defined, all technical and scientific terms used herein have the same meanings as those commonly understood by those skilled in the art to which the present application belongs. The terms used herein are merely for the purpose of describing specific embodiments, but are not intended to limit the present application. The terms "comprising" and "having" and any variations thereof in the description and the claims of the present application as well as the brief description of the accompanying drawings described above are intended to cover non-exclusive inclusion.

In the description of the embodiments of the present application, the technical terms "first", "second", etc. are merely used for distinguishing different objects, and are not to be construed as indicating or implying relative importance or implicitly indicating the number, particular order or primary-secondary relationship of the indicated technical features. In the description of the embodiments of the present application, the phrase "a plurality of" means two or more, unless otherwise explicitly and specifically defined.

The phrase "embodiment" mentioned herein means that the specific features, structures, or characteristics described in conjunction with the embodiment can be encompassed in at least one embodiment of the present application. The phrase at various locations in the description does not necessarily refer to the same embodiment, or an independent or alternative embodiment exclusive of another embodiment. Those skilled in the art understand explicitly or implicitly that the embodiment described herein may be combined with another embodiment.

In the description of the embodiments of the present application, the term "and/or" is merely intended to describe the associated relationship of associated objects, indicating that three relationships can exist, for example, A and/or B can include: only A exists, both A and B exist, and only B exists. In addition, the character "/" herein generally indicates an "or" relationship between the associated objects.

In the description of the embodiments of the present application, the term "a plurality of" means two or more (including two), similarly the term "a plurality of groups" means two or more groups (including two groups), and the term "a plurality of pieces" means two or more pieces (including two pieces).

In the description of the embodiments of the present application, the orientation or position relationship indicated by the technical terms "central", "longitudinal", "transverse", "length", "width", "thickness", "upper", "lower", "front"; "rear", "left", "right", "vertical", "horizontal", "top", "bottom", "inner", "outer", "clockwise", "counterclockwise", "axial", "radial", "circumferential", etc. are based on the orientation or position relationship shown in the accompanying drawings and are merely intended to facilitate and simplify the description of the embodiments of the present application, rather than indicating or implying that the apparatus or element considered must have a particular orientation or be constructed and operated in a particular orientation, and therefore not to be construed as limiting the embodiments of the present application.

In the description of the embodiments of the present application, unless otherwise explicitly specified and defined, the technical terms such as "install", "couple", "connect", and "fix" should be understood in a broad sense, for example, they may be a fixed connection, a detachable connection, or an integrated connection; may be a mechanical connection or an electric connection; and may be a direct connection or an indirect connection by means of an intermediate medium, or may be communication between interiors of two elements or interaction between the two elements. For those of ordinary skill in the art, the specific meanings of the above terms in the embodiments of the present application can be understood according to specific situations.

At present, from the perspective of the development of the market situation, traction batteries are used more and more widely. The traction batteries are not only used in energy storage power systems such as hydroelectric power plants, thermal power plants, wind power plants and solar power plants, but also widely used in electric transportation means such as electric bicycles, electric motorcycles and electric vehicles, and other fields. With the continuous expansion of the application field of traction batteries, the market demand for the traction batteries is also expanding.

In a production process of traction batteries, after cells are made, the cells need to be transferred or transported. However, the cells are easily damaged once having been impacted or scratched, so in order to ensure integrity of the cells during transportation, there is a need to use a packaging material to package and store the cells to avoid damage to the cells by an external force.

At present, a packaging material is generally provided with several receptacles, and cells are placed in the receptacles in one-to-one correspondence to protect the cells. For ease of operation, the receptacles are typically provided evenly in the packaging material, and spacings between adjacent receptacles theoretically need to be consistent. However, in an actual operation, because of influence of factors such as limitations of materials or mechanical errors of slotting tools, the packaging material is often poor in dimensional precision after being shaped, and the spacings between the adjacent receptacles are poorly consistent.

In addition, since there are various types of cells available in the market, and the specifications of different types of cells are not the same, the spacings between the cells are also different.

The above two problems are important reasons why cell packaging cannot be mechanized. However, with the development of new energy technology, the production capacity and production efficiency of batteries have been greatly improved, and manual packaging has a high work intensity and a low work efficiency, which is not beneficial to improving the production efficiency of batteries. Therefore, continuing to use traditional a manual packaging approach will not meet the market demands.

In view of the above considerations, in order to solve the problems of the high work intensity and the low work efficiency of the manual packaging approach, an adjusting device is designed in one or more embodiments of the present application. Double adjustments of spacings between cells upon incoming allow each cell to precisely match a corresponding receptacle in position, facilitating automatic packaging of the cells through a packaging apparatus, which improves the packaging efficiency.

It is to be understood that the adjusting device, packaging apparatus and adjusting method provided by the embodiments of the present application may be applied to the field of batteries, and certainly also to other fields to adjust spacings between members to be adjusted, and the embodiments of the present application impose no limitation thereon.

A battery described in the embodiments of the present application is applicable to a power consuming device. The power consuming device may be, but is not limited to, a cell phone, a laptop, an electric toy, an electric tool, an electromobile, an electric vehicle, a ship, a spacecraft, etc. The electric toy may include a stationary or mobile electric toy, such as a game console, an electric vehicle toy, an electric ship toy, and an electric airplane toy. The spacecraft may include an airplane, a rocket, a space shuttle, a spaceship, etc.

Figure 2:
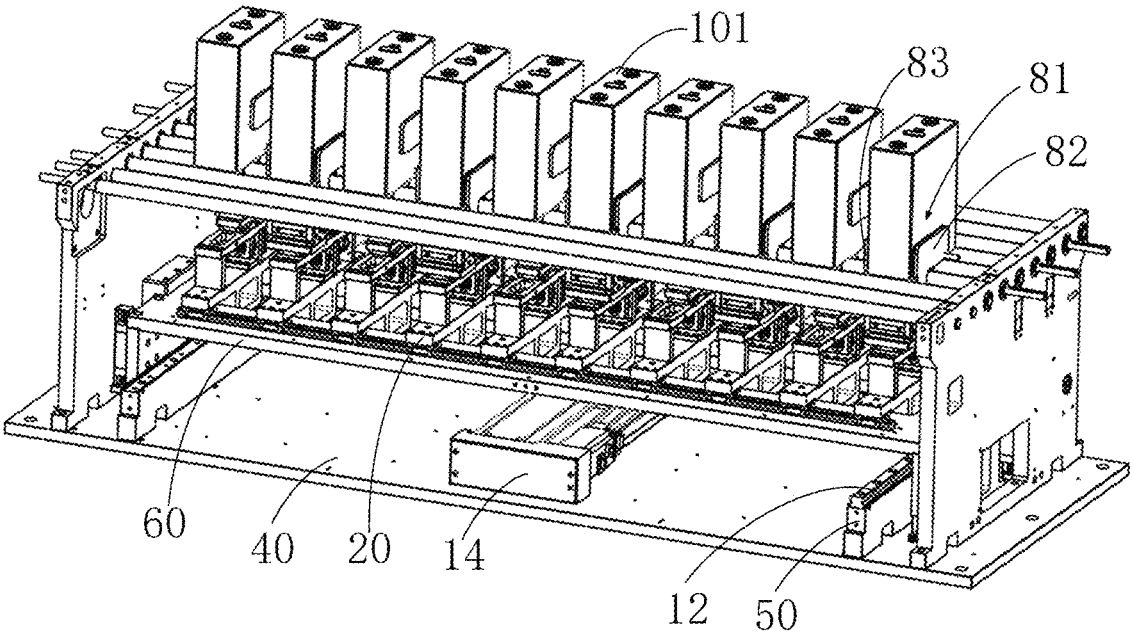
FIG. 2 is a schematic structural diagram of the adjusting device shown in FIG. 1.
Figure 3:
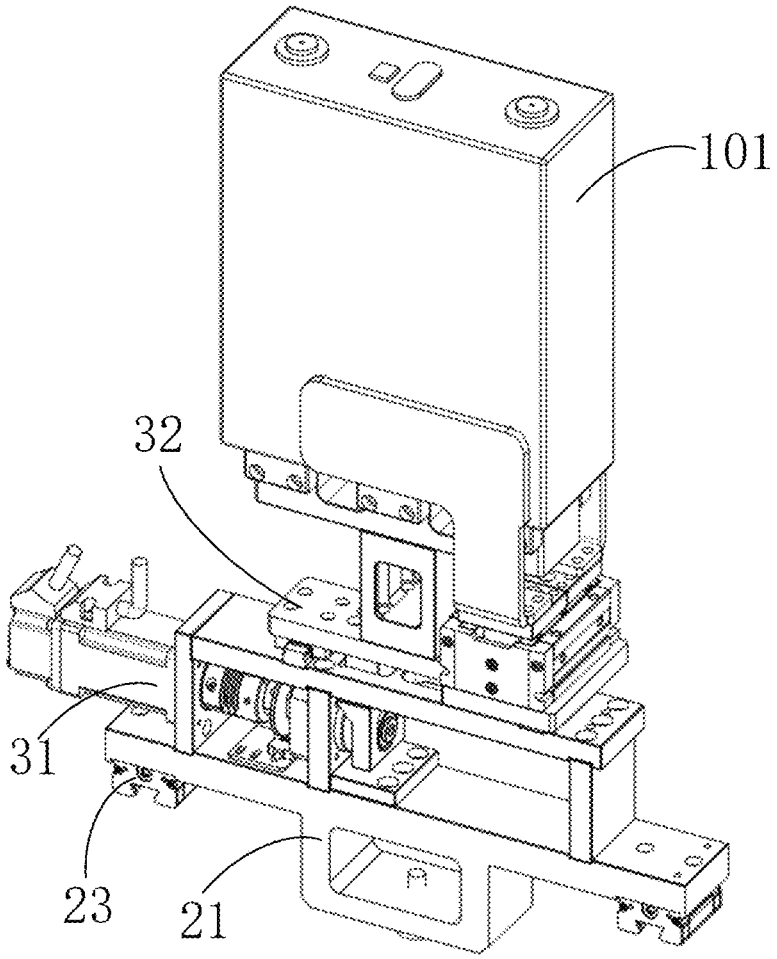
FIG. 3 is a schematic structural diagram of a second adjusting mechanism in the adjusting device shown in FIG. 1.

According to some embodiments of the present application and with reference to FIGS. 1, 2 and 3, one embodiment of the present application provides an adjusting device 100, including a first adjusting mechanism 10, at least two follower mechanisms 20, and at least two second adjusting mechanisms 30. Each of the follower mechanisms 20 is movably disposed on the first adjusting mechanism 10 in a first direction a, the second adjusting mechanisms 30 are connected to the follower mechanisms 20 in one-to-one correspondence, and all the second adjusting mechanisms 30 can follow the follower mechanisms 20 where they are located to move synchronously in the first direction a relative to the first adjusting mechanism 10. Each of the second adjusting mechanisms 30 includes a power assembly 31 and a bearing member 32 that are mounted on each of the follower mechanisms 20, the bearing members 32 are in transmission connection with the power assemblies 31 respectively, and the second adjusting mechanisms can adjust, in the first direction a, a spacing between the bearing members 32 adjacent to the power assemblies under the action of the corresponding power assemblies 31.

Specifically, the bearing members 32 and members to be adjusted 101 are connected in one-to-one correspondence, whereby the members to be adjusted 101 may be disposed on the second adjusting mechanisms 30 in one-to-one correspondence. Further, the second adjusting mechanisms 30 in turn are connected to the first adjusting mechanism 10 through the follower mechanisms 20 in one-to-one correspondence therewith.

The first adjusting mechanism 10 may drive the follower mechanisms 20 to move in the first direction a, and the follower mechanisms 20 drive the second adjusting mechanisms 30 connected thereto to move synchronously in the first direction a, whereby the members to be adjusted 101 may be driven to follow the second adjusting mechanisms 30 to move synchronously in the first direction a.

It is to be noted that each of the follower mechanisms 20 is movably disposed on the first adjusting mechanism 10 in the first direction a, including one case of moving in the first direction a on the first adjusting mechanism 10 and the other one of moving in a direction opposite the first direction a on the first adjusting mechanism 10.

When the first adjusting mechanism 10 drives the follower mechanisms 20 to move, some of the follower mechanisms 20 may move in the first direction a, while the rest of the follower mechanisms 20 may move in the direction opposite the first direction a, whereby the case where the follower mechanisms 20 are gathered together in the first direction a or the case where the follower mechanisms are dispersed from one another in the first direction a may be achieved.

When the follower mechanisms 20 are gathered together in the first direction a, spacings between the follower mechanisms 20 in the first direction a gradually decrease, and when the follower mechanisms 20 are dispersed from one another in the first direction a, the spacings between the follower mechanisms 20 in the first direction a gradually increase. In this way, the spacings between the follower mechanisms 20 in the first direction a may be adjusted to allow for adjustment of spacings between the members to be adjusted 101 in the first direction a.

After being adjusted by the first adjusting mechanism 10, the spacing between the two adjacent members to be adjusted 101 has been adjusted to a theoretical spacing. However, to enable the member to be adjusted 101 to be placed in the corresponding receptacle, the spacing between every two adjacent members to be adjusted 101 is required to match an actual spacing between the two adjacent receptacles corresponding thereto.

In theory, the theoretical spacing between the receptacles is required to be equal to an actual spacing therebetween. However, there may be certain deviations in the actual spacing between the receptacles due to force majeure factors such as mechanical errors, resulting in the actual spacing between some of the receptacles being not equal to the theoretical spacing therebetween.

From this, after a first coarse adjustment of the members to be adjusted 101 by the first adjusting mechanism 10, the corresponding bearing members 32 are driven by the power assemblies 31 on the second adjusting mechanisms 30 to continue moving in the first direction a, until the spacing between every two adjacent bearing members 32 matches the actual spacing between the two adjacent receptacles corresponding thereto. In this way, the members to be adjusted 101 and the receptacles may be disposed in one-to-one correspondence, facilitating placement of the member to be adjusted 101 in the corresponding receptacle.

Through the first coarse adjustment of the members to be adjusted 101 by the first adjusting mechanism 10 and a second fine adjustment of the members to be adjusted 101 by the second adjusting mechanisms 30, the structure described above enables the spacing between every two members to be adjusted 101 to match the actual spacing between the two adjacent receptacles corresponding thereto, i.e., enables the members to be adjusted 101 to precisely align with the receptacles in position, facilitating quick storage of the members to be adjusted 101 in the corresponding receptacles.

It is to be noted that, the members to be adjusted 101 are target objects with spacings to be adjusted, and the specific structure thereof may be determined in accordance with the specific fields to which the adjusting device 100 is applied. When the adjusting device 100 is applied to the field of batteries, the members to be adjusted 101 may be cells. When the adjusting device 100 is applied to other fields, the members to be adjusted 101 may be arranged as target objects with spacings to be adjusted in these fields.

Specifically, the first adjusting mechanism 10 includes an adjusting member 11, and the adjusting member 11 is movably disposed in a second direction b intersecting with the first direction a. Each of the follower mechanisms 20 can convert movement of the first adjusting mechanism 10 in the second direction b into movement of the second adjusting mechanism 30 connected thereto in the first direction a.

The adjusting member 11 refers to a component that can drive the follower mechanisms 20 to move in the first direction a, that is, the adjusting member 11 can be connected to all the follower mechanisms 20, and drive all the follower mechanisms 20 to move in the first direction a or in a direction opposite the first direction a.

Further, the adjusting member 11 may be of a plate-shaped structure, i.e., an adjusting plate. Certainly, the adjusting member 11 may also be of other structures, such as adjusting screws or adjusting connecting rods and other structures, as long as it can drive the follower mechanisms 20 to move in the first direction a or in a direction opposite the first direction a.

Further, the adjusting member 11 is movably disposed in the second direction b, and the second direction b and the first direction a intersect with each other and may be set at an acute or obtuse angle, or perpendicularly to each other. When the first direction a is set perpendicularly to the second direction b, it can be more convenient to convert an amount of movement of the adjusting member 11 in the second direction b into an amount of movement of the second adjusting mechanisms 30 in the first direction a through the follower mechanisms 20.

When the adjusting member 11 moves in the second direction b under the action of an external force, the follower mechanisms 20 convert movement in the second direction b into the movement of the second adjusting mechanisms 30 in the first direction a. In this way, a space necessary for movement of the adjusting device 100 in the first direction a can be reduced, thereby improving the space utilization.

Figure 4:
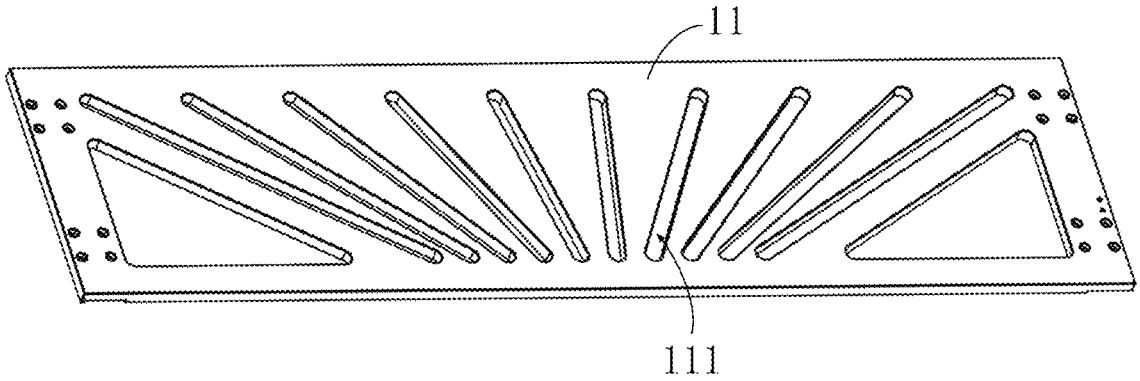
FIG. 4 is a schematic structural diagram of an adjusting member in the adjusting device shown in FIG. 1.
Figure 5:
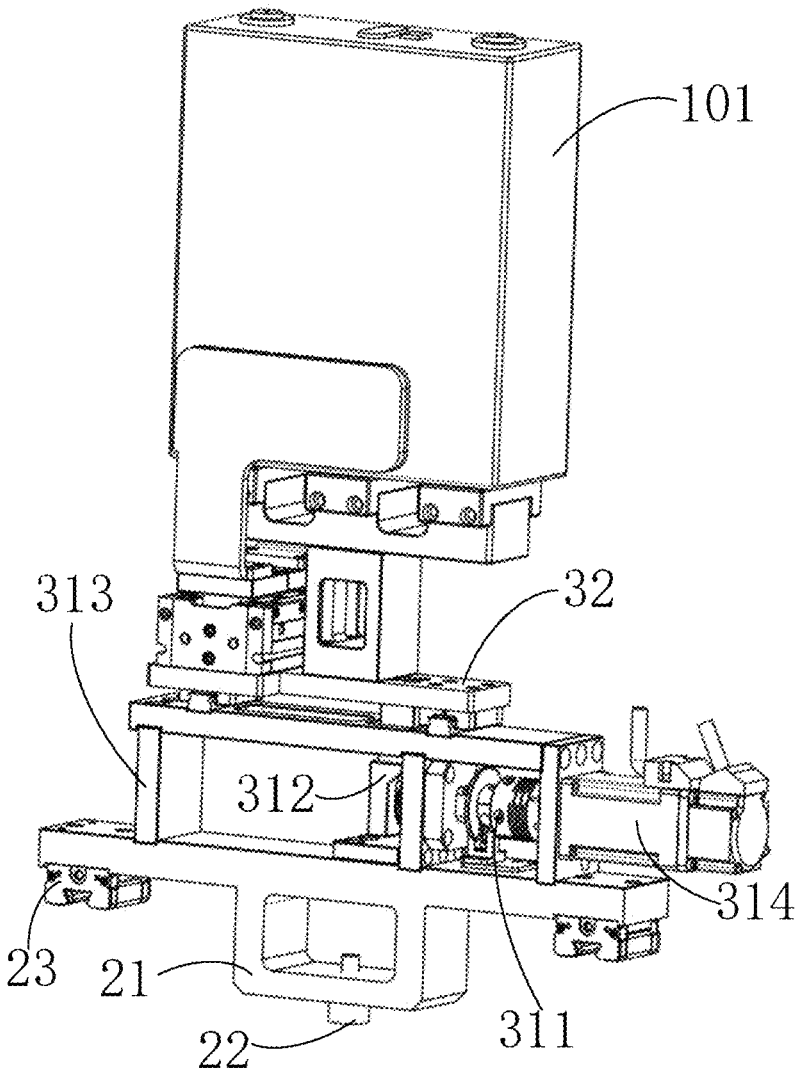
FIG. 5 is a schematic structural diagram of a second adjusting mechanism in the adjusting device shown in FIG. 1.

In some embodiments according to the present application and with reference to FIGS. 4 and 5, the adjusting member 11 is provided with at least two adjusting slots 111, and each of the follower mechanisms 20 includes a follower seat 21 and a follower member 22 disposed on the follower seat 21. All the adjusting slots 111 are disposed at intervals in the first direction a and are disposed radially in the second direction b, and the follower members 22 are disposed in the adjusting slots 111 in one-to-one correspondence.

Specifically, the adjusting slot 111 may be of a blind slot structure, or a through slot structure, i.e., penetrating in a thickness direction of the adjusting member 11. In addition, the adjusting slot 111 has various designs in shape, for example, elliptical, rectangular, etc. Specifically in some embodiments, the adjusting slots 111 are disposed at intervals in the first direction a on the adjusting member 11 and are disposed radially in the second direction b. That is, an extension direction of each adjusting slot 111 intersects with the first direction a and the second direction b, and all the adjusting slots 111 jointly enclose a fan-shaped area on the adjusting member 11.

The follower member 22 may be of a projection structure fitted with the corresponding adjusting slot 111, the follower seat 21 may provide a mounting basis for the follower member 22, that is, the follower member 22 protrudes from the corresponding follower seat 21, and the follower member 22 is inserted into the corresponding adjusting slot 111. When the adjusting member 11 moves, the follower member 22 may follow the adjusting member 11 to move in the adjusting slot 111.

Further, all adjusting slots 111 are divided in the first direction a into two parts symmetrical to each other, and the two parts symmetrical to each other together constitute the fan-shaped area described above. When the adjusting member 11 moves in the second direction b, the follower members 22 in some of the adjusting slots 111 follow the adjusting member 11 to move in the first direction a, and the follower members 22 in other adjusting slots 111 follow the adjusting member 11 in a direction opposite the first direction a, so as to allow for adjustment of a spacing between the follower mechanisms 20 in the first direction a.

Mutual cooperation of the adjusting slots 111 and the follower members 22 may allow for conversion of movement of the adjusting member 11 in the second direction b into movement of the follower members 22 in the first direction a, achieving a simple structure and stable connections.

Figure 6:
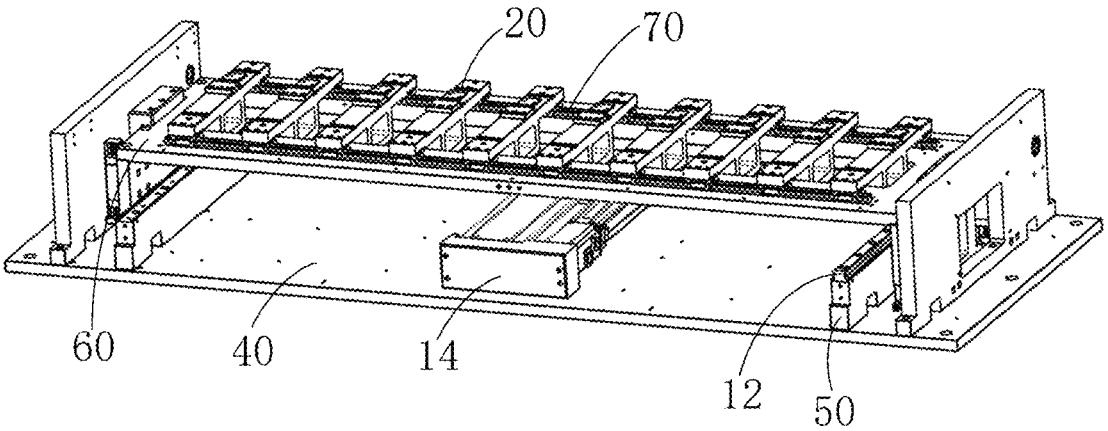
FIG. 6 is a partial schematic structural diagram of the adjusting device shown in FIG. 1.

In some embodiments according to the present application and with reference to FIGS. 1, 2 and 6 together, FIG. 6 is a partial schematic structural diagram of the adjusting device in one embodiment of the present application. Optionally, the first adjusting mechanism 10 further includes a first slide rail 12 and a first slider 13, the first slide rail 12 is disposed extending in a second direction b, and the first slider 13 is connected slidably between an adjusting member 11 and the first slide rail 12 in the second direction b.

In order to reduce the friction coefficient of the adjusting member 11 when moving, movement of the adjusting member 11 in the second direction b is achieved through the first slide rail 12 and the first slider 13. It is to be understood that the movement of the adjusting member 11 in the second direction b may also be achieved through other structures, e.g., guide grooves extending in the second direction b may be provided, and moving wheels rollable in the guide grooves are disposed on the adjusting member 11, thereby allowing for the movement of the adjusting member 11 in the second direction b.

Based on the foregoing structure, on the one hand, mutual cooperation of the first slide rail 12 and the first slider 13 can reduce frictional resistance of the adjusting member 11 in a moving process, making the moving process of the adjusting member 11 smoother. On the other hand, the first slide rail 12 can also provide a support basis for the adjusting member 11, so that the adjusting member 11 is disposed more stably.

Further, for ease of mounting, the adjusting device 100 further includes a base 40 and two supports 50 disposed on the base 40. The two supports 50 are disposed in the first direction a in a spaced manner, and each of the supports 50 is provided with one first slide rail 12 in the second direction b. The adjusting member 11 is supported on the two supports 50 in the first direction a, and the adjusting member 11 is provided with two first sliders 13 at two ends in the first direction a, respectively. The first sliders 13 cooperate with the first slide rails 12, so that the adjusting member 11 is stably supported on the supports 50, and can move in the second direction b under the action of an external force.

In some embodiments according to the present application, optionally, the first adjusting mechanism 10 includes a driving member 14 in driving connection with the adjusting member 11, the driving member 14 functioning to drive the adjusting member 11 to move in the second direction b.

It is to be understood that an external force is also possible to be directly applied in the second direction b on the adjusting member 11 to cause the adjusting member 11 to move in the second direction b, which will not be repeated here.

The driving member 14 is secured on the base 40, and the driving member 14 may be of a screw structure to drive the adjusting member 11 to move in the second direction b. Certainly, the driving member 14 may also be of other driving structures, such as a tow rope structure arranged to extend in the second direction b.

The driving member 14 can provide a driving force for the adjusting member 11 to move in the second direction b, to drive a follower mechanism 20 to move in the first direction a. In this way, a moving distance of the adjusting member 11 in the second direction b can be accurately controlled by controlling the on and off of the driving member 14.

In some embodiments according to the present application and referring to FIGS. 3, 4 and 5 again, optionally the adjusting device 100 includes a first support base 60 and a second slide rail 70 disposed extending in the first direction a on the first support base 60. Each of the follower mechanisms 20 is provided with a second slider 23, and the second slider 23 is disposed slidably on the second slide rail 70 in the first direction a.

The first support base 60 refers to a support 50 structure capable of providing a mounting basis for the second slide rail 70 and providing a support basis for the follower mechanisms 20. Specifically, the first support base 60 may include two securing seats and a support plate across the two securing seats. The two securing seats are disposed in a spaced manner on the base 40 in the first direction a, the support plate is across the two securing seats in the first direction a, and the second slide rail 70 is disposed on the support plate in the first direction a.

Further, there are two second slide rails 70 which are disposed in a spaced manner on the support plate in the second direction b. The support plate is provided with a connection opening, which is located between the two second slide rails 70. In this way, when each of the follower mechanisms 20 is disposed across the two second slide rails 70 through the second sliders 23, the follower mechanism 20 passes through the connection opening so that the follower member 22 on the follower mechanism 20 extends into the adjusting slot 111 in the adjusting member 11.

With such an arrangement, on the one hand, the support plate can play a role of supporting the follower mechanisms 20 such that the follower mechanisms 20 and the adjusting member 11 are connected more stably. On the other hand, mutual cooperation of the second slide rails 70 and the second sliders 23 enables movement of the follower mechanisms 20 in the first direction a to be smoother.

In some embodiments according to the present application and referring to FIG. 5 again, each of power assemblies 31 includes a transmission member 311 and a linkage member 312, and the linkage member 312 is connected between the transmission member 311 and the bearing member 32 and drives the bearing member 32 to move in the first direction a.

The transmission member 311 refers to a component capable of providing a driving force for the bearing member 32 to move in the first direction a. The linkage member 312 is fixedly connected to the bearing member 32 and is movably connected to the transmission member 311. When moving under the action of an external force, the transmission member 311 may drive the linkage member 312 to move in the first direction a, thereby driving the bearing member 32 to move in the first direction a.

Therefore, the transmission member 311 may provide the driving force for the bearing member 32 to move in the first direction a through the linkage member 312, such that the driving force on the transmission member 311 can be transmitted to the bearing member 32 more accurately.

In some embodiments according to the present application, optionally, each of the power assemblies 31 includes a second support base 313, and the second support base 313 is fixedly disposed on the corresponding follower mechanism 20. Each of the transmission members 311 is rotatably disposed on the corresponding second support base 313, and the linkage member 312 functions to convert rotational movement of the transmission member 311 into linear movement of the bearing member 32 in the first direction a.

The second support base 313 may provide a mounting basis for the corresponding transmission member 311. Specifically, one end of the transmission member 311 passes through the second support base 313, with the other end secured on the second support base 313, so that the transmission member 311 is mounted on the second support base 313. The second support base 313 is provided with a through hole allowing the linkage member 312 to pass through. One end of the linkage member 312 is fixedly connected to the bearing member 32, and the other end passes through the through hole and is movably connected to one end of the transmission member 311 that passes through the second support base 313. When the transmission member 311 rotates, the linkage member 312 is driven to move in the first direction a in the through hole, thereby driving the bearing member 32 to move in the first direction a.

As the rotational movement of the transmission member 311 is converted into the linear movement of the bearing member 32 in the first direction a through the linkage member 312, less occupied space may be required in a moving process of the transmission member 311, and the entire structure of the power assemblies 31 can be simplified.

Figure 7:
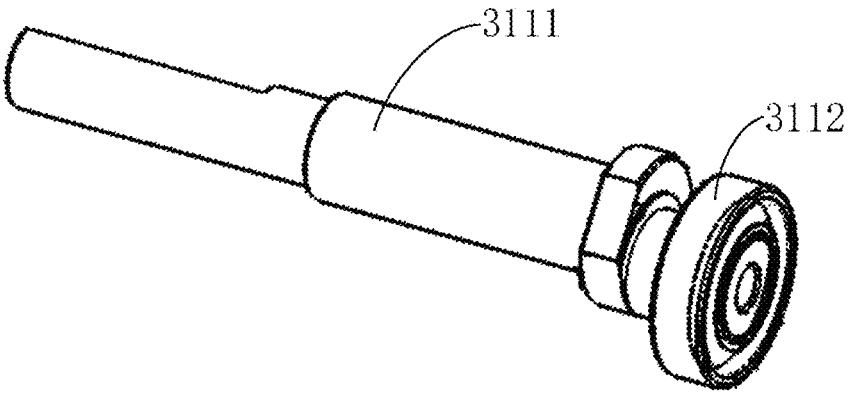
FIG. 7 is a schematic structural diagram of a transmission member in the adjusting device shown in FIG. 1.

In some embodiments according to the present application and referring to FIG. 5 in conjunction with FIG. 7, each of the power assemblies 31 includes a power member 314, and the transmission member 311 includes an eccentric shaft 3111 and a follower wheel 3112. One end of the eccentric shaft 3111 is in transmission connection with the power member 314, and the follower wheel 3112 is disposed at the other end of the eccentric shaft 3111. One end of the linkage member 312 is fixedly connected to the bearing member 32, with the other end sleeving over the follower wheel 3112, and the linkage member can move linearly in the first direction a under the action of an eccentric force of the follower wheel 3112.

The power member 314 refers to a component that provides a driving force for the transmission member 311. Specifically, the power member 314 may be arranged as a servo motor in driving connection with the transmission member 311 to drive the power member 314 to perform rotary movement.

The other end of the linkage member 312 sleeves over the follower wheel 3112, which specifically refers to that the linkage member 312 is provided with a follower hole, with the follower wheel 3112 disposed in the follower hole. In addition, an inner diameter of the follower hole in the first direction a is less than an inner diameter of the follower hole in a vertical direction. Specifically, the follower hole may be arranged as an elongated hole extending in the vertical direction. When the follower wheel 3112 is driven by the eccentric shaft 3111 to rotate, the follower wheel 3112 constantly abuts against left and right inner walls of the follower hole. When the follower wheel 3112 abuts against the left and right inner walls of the follower hole, the follower wheel 3112 applies a pressure to the linkage member 312 in the first direction a or a direction opposite the first direction a, and the linkage member 312, under the action of the pressure, drives the bearing member 32 to move in the first direction a or the direction opposite the first direction a.

The corresponding bearing member 32 is driven to move in the first direction a by the power member 314 on the corresponding second adjusting mechanism 30. In this way, after spacings between members to be adjusted 101 on all the bearing members 32 are collectively adjusted by the first adjusting mechanism 10, a second adjustment may be provided for at least some of the members to be adjusted 101 by the second adjusting mechanisms 30, thereby precisely aligning each member to be adjusted 101 with a corresponding receptacle.

When rotating synchronously with the eccentric shaft 3111, the follower wheel 3112 may transmit an eccentric force to the linkage member 312, allowing for conversion between rotational movement and linear movement. In addition, positional adjustment for a member to be adjusted on the bearing member 32 is achieved through the linkage member 312 driving the bearing member 32 to move linearly in the first direction a.

In some embodiments according to the present application, optionally, the adjusting device 100 includes at least two clamping mechanisms 80, the clamping mechanisms 80 are disposed on the bearing members 32 in one-to-one correspondence, and each of the clamping mechanisms 80 has a clamping space 81 for securing a member to be adjusted 101.

The clamping mechanism 80 refers to a structure that may provide support and securing for the member to be adjusted 101. Specifically, the clamping mechanism 80 may have a variety of designs in structure, for example, jaw structures or limiting groove structures. The members to be adjusted 101 are in one-to-one correspondence with the clamping mechanisms 80, and the members to be adjusted 101 are secured in the clamping spaces 81 so that the clamping mechanisms 80 drive the members to be adjusted 101 to move synchronously.

The clamping mechanism 80 may stably connect the corresponding member to be adjusted to the corresponding bearing member 32, allowing the bearing member 32 to smoothly drive the member to be adjusted to move in the first direction a.

In some embodiments according to the present application, optionally, each of the clamping mechanisms 80 includes a first clamping member 82 and a second clamping member 83 that are movably disposed on a corresponding bearing member 32 in the first direction a, and a clamping space 81 is defined between the first clamping member 82 and the second clamping member 83 in the first direction a.

It is to be understood that the first clamping member 82 and the second clamping member 83 may be movably disposed on the corresponding bearing member 32 in the first direction a through a driving structure, and the first clamping member 82 and the second clamping member 83, under the action of a driving force of the driving structure, are moved close to or away from each other in the first direction a, enabling the size of the clamping space 81 to vary.

Therefore, the size of the clamping space 81 may be adjusted according to the size of a member to be adjusted 101, enabling the clamping space to adapt to different dimensions of the members to be adjusted 101, and accordingly improving practicability of the adjusting device 100.

In some embodiments according to the present application, the adjusting device 100 includes a control assembly (not shown in the figures), and the control assembly is in communicative connection with the power assemblies 31 and can control the power assemblies 31 to be turned on or off.

The control assembly refers to a component that may accurately control the power members 314 to be turned on and off according to an external instruction, e.g., if the external instruction is a specific position of each receptacle, when there are deviations in the positions of some of the members to be adjusted 101 and the corresponding receptacles, the control assembly may control the power members 314 on the second adjusting mechanisms 30 corresponding to these members to be adjusted 101 to be turned on, so as to drive, through the transmission member 311, corresponding bearing members 32 to move by a moving distance in the first direction a, and to control these power members 314 again to be turned off until the members to be adjusted 101 on the bearing members 32 match the corresponding receptacles in position.

The control assembly enables precise control for each power assembly 31, ensuring that the power assembly 31 drives the bearing member 32 to move by a fixed distance in the first direction a, so as to enable accurate positioning for the position of the bearing member 32.

Specifically, the control assembly may be arranged as a CCD visual assembly, on the one hand, positional detection and positioning for the receptacles may be achieved, and on the other hand, the corresponding power members 314 may be controlled to be turned on or off to allow for positional adjustment of at least some of the members to be adjusted 101 in the first direction a.

Based on the same concept as the adjusting device 100 described above, the present application provides a packaging apparatus, including the adjusting device 100 as described above and a packaging box. The adjusting device 100 functions to adjust a spacing between two adjacent members to be adjusted 101. The packaging box is provided with a plurality of groups of receptacles. Each group of receptacles includes at least two receptacles disposed at intervals in the first direction a. The receptacles serve to hold the members to be adjusted 101.

The packaging apparatus may allow for adjustment of the spacing between the adjacent members to be adjusted 101, and can store the members to be adjusted 101 in the receptacles in one-to-one correspondence, allowing for quick packaging of the members to be adjusted 101.

According to some embodiments of the present application, the present application provides a method for adjusting a spacing between two adjacent cells, the method including the following steps:

acquiring a theoretical spacing between two adjacent cell receptacles on a cell packaging box in a first direction a;

adjusting all cells to move in the first direction a, so that a spacing between two adjacent cells in the first direction a equals the theoretical spacing;

acquiring an actual spacing between the two adjacent cell receptacles on the cell packaging box; and adjusting a spacing between every two adjacent cells to match the actual spacing between two adjacent cell receptacles corresponding thereto.

In a cell packaging process, there is a need for placing the cells in the cell receptacles on the cell packaging box in one-to-one correspondence. Theoretically, the spacings between the receptacles in the first direction a should be equal, but due to force majeure factors such as mechanical errors, there are certain deviations in the spacings between receptacles in an actual product.

The deviations described above may exist between several adjacent ones of the receptacles. Therefore, the theoretical spacing between the adjacent cell receptacles on the cell packaging box is acquired first, a spacing between every two adjacent cells in the first direction a is adjusted to be equal to the theoretical spacing described above. In this case, most of the cells have matched the corresponding receptacles in position. Further, the actual spacing between every two adjacent cell receptacles is acquired again, and the spacing between the corresponding two adjacent cells is adjusted to match the actual spacing between the corresponding two adjacent cell receptacles. Therefore, even if the cells and the corresponding cell receptacles are disposed in an aligned manner, the spacing between every two adjacent cells may match the actual spacing between the two adjacent cell receptacles corresponding thereto, facilitating placement of the cells in the corresponding cell receptacles.

Specifically, when the adjusting method described above is applied in the adjusting device 100 described above, the theoretical spacing between two adjacent cell receptacles on the cell packaging box in the first direction a is acquired first. An adjusting member 11 is controlled by a driving member 14 to move in the second direction b, and the follower mechanisms 20 each are driven by the adjusting member 11 to move in the first direction a or a direction opposite the first direction a, thereby allowing for spacing adjustment of the follower mechanisms 20 in the first direction a such that a spacing between every two adjacent follower mechanisms 20 in the first direction a is equal to the theoretical spacing. In this case, the spacing between every two adjacent cells in the first direction a may be equal to the theoretical spacing between the cell receptacles.

Further, the actual spacing between two adjacent cell receptacles is acquired first through a control assembly and is compared with the theoretical spacing. When cell receptacles with the actual spacing being not the same as the theoretical spacing are found, power members 314 on second adjusting mechanisms 30 corresponding to the cell receptacles are controlled by the control assembly to start working, and the power members 314 control linkage members 312 to drive bearing members 32 connected thereto to move in the first direction a or in a direction opposite the first direction a, thereby allowing for movement of the cells secured on these bearing members 32 in the first direction a. When the actual spacing between one cell and that adjacent thereto matches the actual spacing between the cell receptacles, the control assembly controls the corresponding power member 314 to stop working, and the bearing member 32 and the cell thereon stop moving, whereby alignment of the cell with the corresponding cell receptacle may be achieved.

If the cells and the corresponding cell receptacles are aligned in position in one-to-one correspondence, the cells may be placed in the corresponding cell receptacles, allowing for quick packaging of the cells.

Finally, it should be noted that the above embodiments are merely used for illustrating rather than limiting the technical solutions of the present application. Although the present application has been illustrated in detail with reference to the foregoing embodiments, it should be understood by those of ordinary skill in the art that the technical solutions described in the foregoing embodiments may still be modified, or some or all of the technical features thereof may be equivalently substituted; and such modifications or substitutions do not make the essence of the corresponding technical solution depart from the scope of the technical solutions of the embodiments of the present application, and should fall within the scope of the claims and the description of the present application. In particular, the technical features mentioned in the embodiments can be combined in any manner, provided that there is no structural conflict. The present application is not limited to the specific embodiments disclosed herein but includes all the technical solutions that fall within the scope of the claims.

The invention claimed is:

1. An adjusting device, comprising:

a first adjuster;

at least two followers, each of the followers being movably disposed on the first adjuster in a first direction; and at least two second adjusters connected to the at least two followers in one-to-one correspondence; wherein all the second adjusters are capable of following the followers where they are located to move synchronously in the first direction relative to the first adjuster; and wherein each of the second adjusters comprises a power assembly and a bearing that are mounted on each of the followers, the bearing is in transmission connection with the power assembly, and the power assembly is configured to drive the bearing, independently from other bearings, the first adjuster, and the at least two followers, to move in the first direction so that the second adjusters are capable of adjusting, in the first direction, a spacing between bearings adjacent to power assemblies under the action of the corresponding power assemblies, and each of the at least two second adjusters including the power assembly and the bearing is wholly disposed on a side of one of the at least two followers opposite from the first adjuster.

2. The adjusting device according to claim 1, wherein the first adjuster comprises an adjusting structure that is movably disposed in a second direction intersecting with the first direction; and each of the followers is capable of converting movement of the first adjuster in the second direction into movement of the second adjuster connected thereto in the first direction.

3. The adjusting device according to claim 2, wherein the adjusting structure is provided with at least two adjusting slots, and each of the follower comprises a follower seat and a follower structure disposed on the follower seat;

wherein all the adjusting slots are disposed at intervals in the first direction and are disposed radially in the second direction; and the follower structures are disposed in the adjusting slots in one-to-one correspondence.

4. The adjusting device according to claim 2, wherein the first adjuster further comprises a first slide rail and a first slider, the first slide rail is disposed extending in the second direction, and the first slider is connected slidably between the adjusting structure and the first slide rail in the second direction.

5. The adjusting device according to claim 2, wherein the first adjuster comprises a driver in driving connection with the adjusting structure, the driving structure functioning to drive the adjusting structure to move in the second direction.

6. The adjusting device according to claim 1, wherein the adjusting device comprises a first support base and a second slide rail extending in the first direction on the first support base, and each of the followers is provided with a second slider that is disposed slidably on the second slide rail in the first direction.

7. The adjusting device according to claim 1, wherein the power assembly comprises a transmission structure and a linkage structure, and the linkage structure is connected between the transmission structure and the bearing and drives the bearing to move in the first direction.

8. The adjusting device according to claim 7, wherein the power assembly further comprises a second support base secured on the corresponding follower, the transmission structure is rotatably disposed on the second support base, and the linkage structure functions to convert rotational movement of the transmission structure into linear movement of the bearing in the first direction.

9. The adjusting device according to claim 7, wherein the power assembly further comprises a power structure, the transmission structure comprises an eccentric shaft and a follower wheel, one end of the eccentric shaft is in transmission connection with the power structure, and the follower wheel is disposed at the other end of the eccentric shaft; and one end of the linkage structure is fixedly connected to the bearing, with the other end sleeving over the follower wheel, and the linkage structure is capable of moving linearly in the first direction under the action of an eccentric force of the follower wheel.

10. The adjusting device according to claim 1, wherein the adjusting device comprises at least two clampers disposed on the bearings in one-to-one correspondence, and each of the clampers has a clamping space for securing a structure to be adjusted.

11. The adjusting device according to claim 10, wherein each of the clampers comprises a first clamping structure and a second clamping structure that are movably disposed on the corresponding bearing in the first direction, and the clamping space is defined between the first clamping structure and the second clamping structure in the first direction.

12. The adjusting device according to claim 1, wherein the adjusting device comprises a control assembly, and the control assembly is in communicative connection with the power assemblies and can control the power assemblies to be turned on or off.

13. A packaging apparatus, comprising the adjusting device according to claim 1 and a packaging box, wherein the adjusting device functions to adjust a spacing between two adjacent structures to be adjusted, the packaging box is provided with a plurality of groups of receptacles, each group of receptacles comprises at least two receptacles disposed at intervals in the first direction, and the receptacles serve to hold the structures to be adjusted.

14. The adjusting device according to claim 1, wherein the each of the second adjusters further comprises a transmission structure and a linkage structure, and the power assembly is configured to drive the transmission structure to rotate, and the linkage structure is configured to convert rotational movement of the transmission structure into linear movement of the bearing in the first direction.

* * * * *